US012343609B2

(12) United States Patent
Lukongwa et al.

(10) Patent No.: US 12,343,609 B2
(45) Date of Patent: Jul. 1, 2025

(54) SIMULATED DEFENDER FOR SPORTS TRAINING

(71) Applicants: Tonny Lukongwa, Everett, WA (US); Cyrus Nkonge Lukongwa, Kampala (UG)

(72) Inventors: Tonny Lukongwa, Everett, WA (US); Cyrus Nkonge Lukongwa, Kampala (UG)

( * ) Notice: Subject to any disclaimer, the term of this patent is extended or adjusted under 35 U.S.C. 154(b) by 174 days.

(21) Appl. No.: 18/246,220

(22) PCT Filed: Sep. 22, 2021

(86) PCT No.: PCT/US2021/051593
§ 371 (c)(1),
(2) Date: Mar. 22, 2023

(87) PCT Pub. No.: WO2022/076172
PCT Pub. Date: Apr. 14, 2022

(65) Prior Publication Data

US 2023/0356054 A1 Nov. 9, 2023

Related U.S. Application Data

(60) Provisional application No. 63/081,528, filed on Sep. 22, 2020.

(51) Int. Cl.
*A63B 69/34* (2006.01)
*A63B 69/00* (2006.01)
*A63B 71/02* (2006.01)

(52) U.S. Cl.
CPC ..... *A63B 69/34* (2013.01); *A63B 69/002* (2013.01); *A63B 71/023* (2013.01); *A63B 2071/025* (2013.01); *A63B 2220/806* (2013.01)

(58) Field of Classification Search
CPC ..... A63B 69/34; A63B 69/002; A63B 71/023; A63B 2071/025; A63B 2220/806; A63B 69/0053; A63B 2071/0625; A63B 71/0622; A63B 2220/12; A63B 2220/20; A63B 2220/801; A63B 2225/20
See application file for complete search history.

(56) References Cited

U.S. PATENT DOCUMENTS 9,259,634 B1 * 2/2016 Bouse ..... A63B 69/34
9,937,401 B2 * 4/2018 Lukongwa ..... A63B 69/0071

* cited by examiner

*Primary Examiner* — Jeffrey S Vanderveen
(74) *Attorney, Agent, or Firm* — Larsen IP, PLLC; James C. Larsen

(57) ABSTRACT

A sports training machine with limbs that dynamically rotate to intercept a player/user moving with a ball. As the player/user moves with the ball while avoiding the dynamic and rotary limb structures, the resulting path traversed by the User/Player enables the player/user to practice real game skills.

14 Claims, 7 Drawing Sheets

SIMULATED DEFENDER FOR SPORTS TRAINING

BACKGROUND

Athletes of certain team sports such as football (soccer in the U.S.), basketball, or other ball-handling sports may wish to practice certain skills without necessarily engaging the time and patience of a training partner. In particular, mastering a "step-over" skill requires repetition and normally involves at least a ball-handling participant and a defender. While a practice dummy or similar stationary "defender" can provide some benefit for placement, it is not a close approximation of a real defender because it does not react to the ball-handler's actions. Even in situations where a team is practicing the skill together, in conventional scenarios every Player practicing the skill must be matched with at least one defender such that only one of the two can practice the skill at a time. Accordingly, there is a need for a mechanism to permit a Player to practice ball handling skills repeatedly without requiring a live defender, while still addressing movement of a defender.

SUMMARY

This Summary introduces a selection of concepts in a simplified form in order to provide a basic understanding of some aspects of the present disclosure. This Summary is not an extensive overview of the disclosure, and is not intended to identify key or critical elements of the disclosure or to delineate the scope of the disclosure. This Summary merely presents some of the concepts of the disclosure as a prelude to the Detailed Description provided below.

According to an embodiment, a dribble training apparatus includes a base support structure, a rotation structure and one or more obstacles. The base support structure supports the rotation structure which extends vertically from the base support structure and is configured to rotate about a first vertical axis. The one or more obstacles extend from the rotation structure. A first motor is configured to cause rotation of the rotation structure about the first vertical axis.

BRIEF DESCRIPTION OF THE DRAWINGS

These and other objects, features and characteristics of the present disclosure will become more apparent to those skilled in the art from a study of the following Detailed Description in conjunction with the appended claims and drawings, all of which form a part of this specification. In the drawings:

In the drawings, the same reference numerals and any acronyms identify elements or acts with the same or similar structure or functionality for ease of understanding and convenience. The drawings will be described in detail in the course of the following Detailed Description.

DETAILED DESCRIPTION

Various examples of the present invention will now be described. The following description provides specific details for a thorough understanding and enabling description of these examples. One skilled in the relevant art will understand, however, that the present invention may be practiced without many of these details. Likewise, one skilled in the relevant art will also understand that the present invention can include many other obvious features not described in detail herein. Additionally, some well-known structures or functions may not be shown or described in detail below, so as to avoid unnecessarily obscuring the relevant description.

Descriptions of well-known starting materials, processing techniques, components and equipment may be omitted so as not to unnecessarily obscure the present invention in detail. It should be understood, however, that the detailed description and the specific examples, while indicating (e.g., preferred) embodiments of the present invention, are given by way of illustration only and not by way of limitation. Various substitutions, modifications, additions and/or rearrangements within the spirit and/or scope of the underlying inventive concept will become apparent to those skilled in the art from this disclosure.

Figure 1:
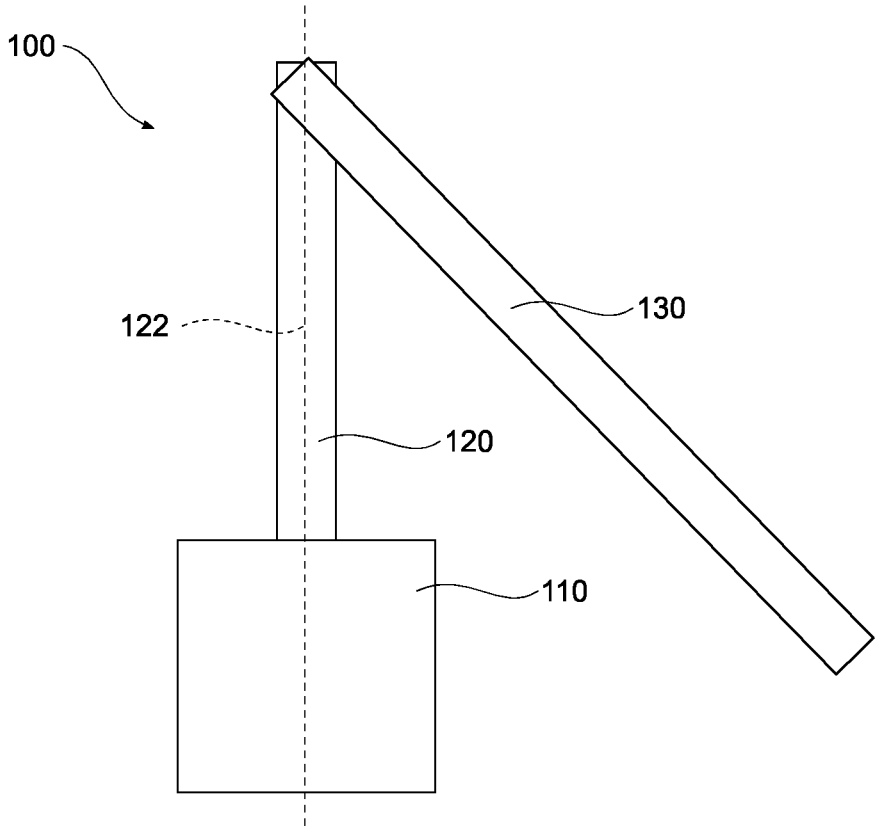
FIG. 1 is a block diagram of a dribble training apparatus, according to an embodiment.

FIG. 1 is a block diagram of a dribble training apparatus 100, according to an embodiment. Those having skill in the art will acknowledge that the placement and orientation of the blocks in the diagram are not necessarily limiting of the represented structure. The dribble training apparatus 100, 200, 500 includes a base support structure 110, a rotation structure 120 and one or more obstacles 130. Included with the base support structure 110 is a first motor (e.g., 402 in FIG. 4). The base support structure may include features for stabilization of the dribble training apparatus 100 against the ground as the rotation structure 120 and one or more obstacles move. For example, the base support structure 110 may include legs extending from a central location (e.g., a vertical axis), a heavy base plate, grass spikes and/or screws, or the like. In some embodiments, the base support structure 110 may include a fixed vertical pipe or shaft rising from a such legs/plate/etc. and supporting other features of the dribble training apparatus.

The rotation structure 120 extends vertically from the base support structure 110 and may rotate about a first vertical axis 122. The rotation structure 120 may include several sub elements. As discussed in more detail below, the rotation structure 120 may include one or more of a drive shaft of the first motor 402, 502, a receptacle of a drive structure 214 described later in specific embodiments, a permanent or removable vertical shaft driven by the motor 402, 502 or a combination of these. The rotating structure may include a flange or cross member to which the one or more obstacles may be operably connected.

The one or more obstacles 130 may be attached to or extend from the rotation structure 120, according to an embodiment. In some implementations each obstacle 130 may be fixed with respect to the rotating structure 120 such that the obstacle moves about the axis at a fixed angle. In another embodiment, the one or more obstacles may be separately driven such that their angle with respect to the plane of the base surface upon which the apparatus rests. The one or more obstacles may include a single obstacle, two obstacles, or more. However, in a typical implementation, the one or more obstacles 130 are configured to simulate legs or arms of a defender in a corresponding sport. For example, in a football-oriented implementation, the two or more obstacles 130 may simulate legs of a defender. In some instances the two or more obstacles 130 may include feet and/or shoes to more closely approximate a live defender.

The first motor (e.g., 402, 502) may be configured to cause rotation of the rotation structure 120 about the first vertical axis 122. The motor may include, but is not limited to, a stepper motor. As described below and illustrated in the figures, the first motor 402, 502 may be incorporated into the base structure 110 in various positions.

The basic configuration illustrated in FIG. 1 represents basic elements common to different embodiments described below.

Figure 2:
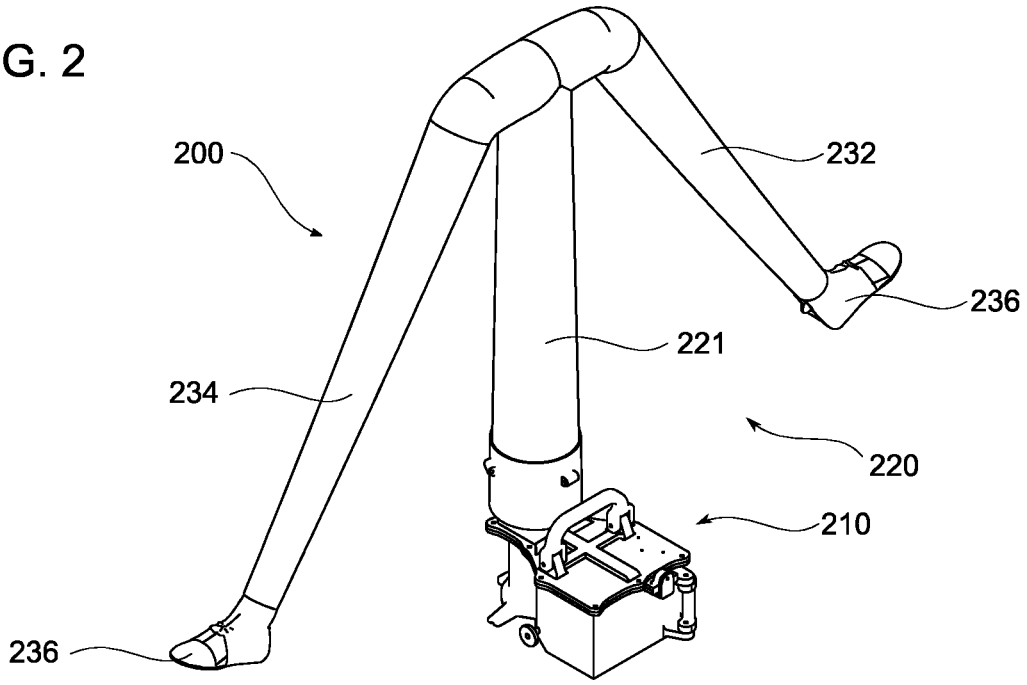
FIG. 2 is a perspective view of a dribble training apparatus, according to an embodiment.

FIG. 2 is a perspective view of a dribble training apparatus 200, according to an embodiment. Such embodiment is portable and includes several features aimed at enhancing portability while maintaining usefulness. The dribble training apparatus 200 includes a base support structure 210 a rotation structure 220 that may include a vertical riser 221. The vertical riser 221 may be integrated with a left obstacle 232 and a right obstacle 234. The left and right obstacles 232, 234 may respectively include a foot feature 236.

Figure 3A:
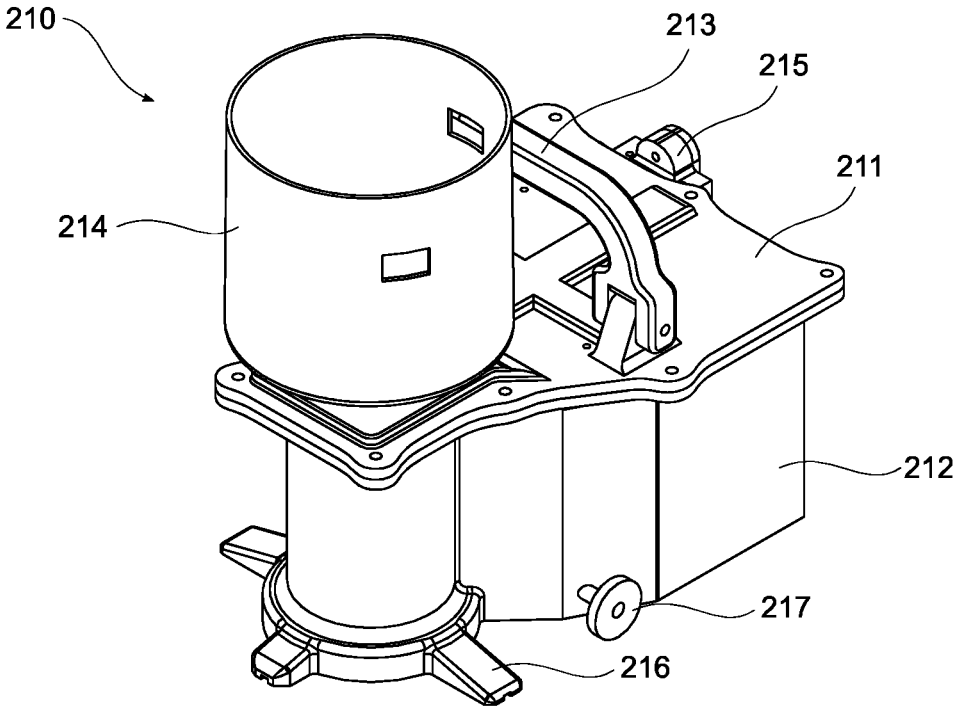
FIGS. 3A and 3B are rear perspective views of a base support structure of a dribble training apparatus, according to an embodiment.
Figure 3B:
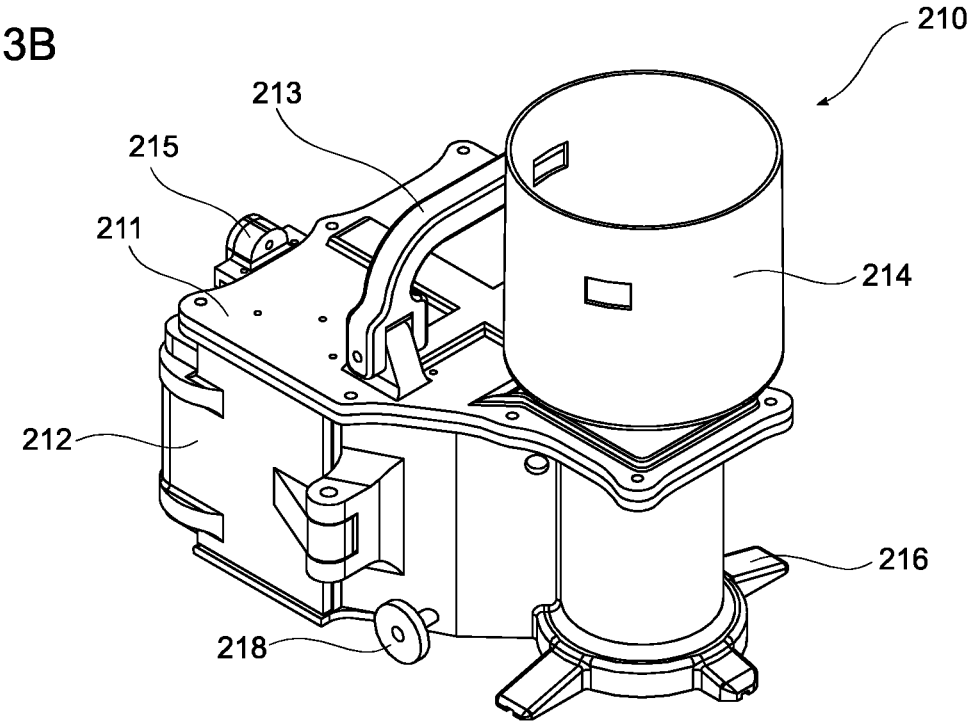

FIGS. 3A and 3B are rear perspective views of a base support structure 210 of the dribble training apparatus 200 in FIG. 2, according to an embodiment. The base support structure 210 may include a housing 212 having a top plate 211. The housing may include or hold a drive structure 214 for the vertical riser 221. The drive structure 214 may include a receptacle affixed to a drive mechanism, e.g., a motor, for rotating the vertical riser-obstacle assembly. That is, the receptacle of the drive structure 214 may move together with, or in response to movement of the drive mechanism. The receptacle of the drive structure 214 may include retaining features (not labeled) for holding the vertical riser 221 in place. The housing 212 may include stabilizing features such as a wide bottom area and/or extensions 216 to limit tipping of the base support structure 210. In some embodiments, the housing 212 may include features for accessing elements within the housing 212, such as a described in conjunction with FIG. 4, for maintenance, repair, or further portability features.

According to an embodiment, the base support structure 210 may include one or more cameras 215 for detecting a player movement. The base support structure may further include a handle 213 to facilitate conveyance by hand. The base support structure may also include left and right wheels 217, 218 to facilitate movement of the base structure along a surface. This feature is described in greater detail below.

A proximal end of the vertical riser 221 may be held by the receptacle of the drive structure 214, and a distal end of the vertical riser 221 may support a first obstacle 232 of the one or more obstacles and a second obstacle 234 of the one or more obstacles. As illustrated, the left and right obstacles 232 234 may depend from an upper portion of the vertical riser 221 at an angle, such that distance between the vertical riser 221 and each respective obstacle 232, 234 increases from top to bottom of the vertical riser 221.

Figure 4:
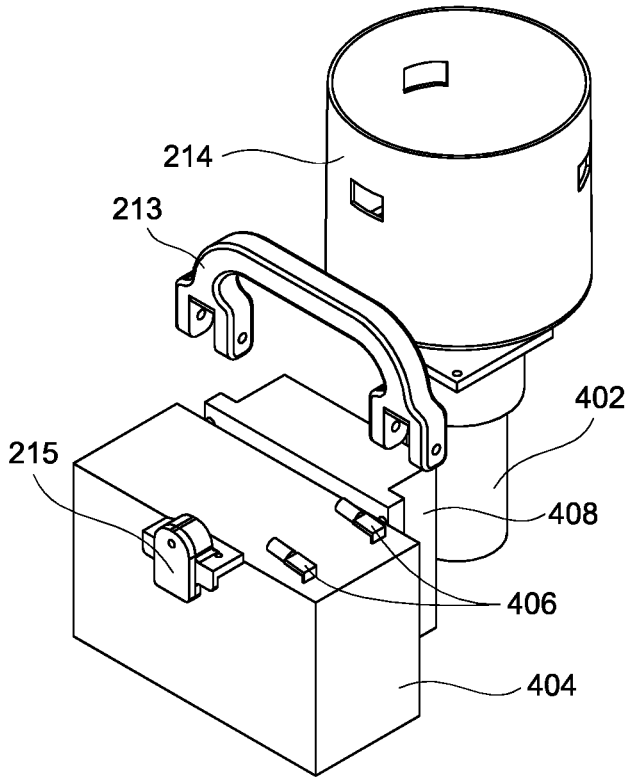
FIG. 4 is a perspective view of elements housed in a base support structure of a dribble training apparatus, according to an embodiment.

FIG. 4 is a perspective view of elements housed in the base support structure 210 of a dribble training apparatus 200, according to an embodiment. The base support structure 210 may include within its housing 212 a first electric motor 402 configured to cause the drive structure 214 to move (i.e., to at least partially rotate) about the first vertical axis 122. The housing 212 may further include control circuitry 408 operably connected to the first motor 402 and configured to control operation of at least the first motor 402. In some embodiments the control circuitry 408 may receive sensor inputs, e.g., camera inputs, motion detectors, audio signals, remote control signals, and/or etc., and may cause the motor 402 to engage based on the inputs. In another embodiment, the control circuitry may be configured to cause random or periodic engagement of the motor 402. It will be acknowledged that the electrical elements housed in the housing 212 may include wires, connectors, etc.; e.g., battery terminals 406 in FIG. 4.

In some embodiments, the control circuitry 408 may analyze input signals to identify a particular predetermined movement or type of movement of a user, and may engage the motor 402 based on the analysis of the inputs.

For example, according to an embodiment the housing 212 may be structurally configured to accommodate one or more cameras 215 as input sensors. For example, the base support structure 210 may have the one or more cameras 215 mounted thereon, each configured to capture one or more images of a user. The control circuitry 408 may be configured to analyze images captured by the one or more cameras 215. In an embodiment, the control circuitry 408 may be configured to detect, in the one or more captured images a motion of a user. For example, the control circuitry may be configured to recognize a particular position or movement of the user. In some implementations, the detection of the user's motion may be compared with a plurality of predetermined movements for which defining criteria may be detected. Defining criteria for the plurality of predefined movements may be stored in a memory element (not shown) of the control circuitry 408. The control circuitry 408 may include one or more processors (not shown) for receiving and analyzing data and for driving movement of the obstacle(s) 232, 234. According to an embodiment, actions and movements of the dribble training apparatus 200 may have a variety of selectable settings. For example, the movements may be made faster, slower, and/or to a greater distance or rotation based on a difficulty setting.

Upon detecting in the one or more images any one of the plurality of predetermined movements of the user, the control circuitry of the base support structure 210 may causing the first motor 402 to rotate the drive structure 214 about the vertical axis 122 by a predetermined amount of rotation in a predetermined rotation direction corresponding to the detected motion of the user.

The base support structure may include a power source 404 electrically connected to the control circuitry 408 and configured to supply electrical power to the control circuitry 408 and the first motor 402. According to an embodiment, the power source 404 may be or include a battery. In some implementations, the battery may be rechargeable. In other embodiments, the power source 404 may include circuitry to accommodate power received via standard power grid. For example, the base support structure 210 may be configured to convert alternating current power to direct current of an appropriate voltage (e.g., 12 volts, 6 volts or other voltage).

According to an embodiment, the base support structure 210 may include two or more wheels 217, 218 operably affixed to the housing 212. In some embodiments, the wheels 217, 218 may accommodate manual movement of the dribble training apparatus 200. In other embodiments, the base support structure 210 may include means for driving the wheels 217, 218, such as one or more drive motors. In such embodiments, the control circuitry 408 may be configured to move the dribble training apparatus 200 via the wheels 217, 218 based on the analysis of received instructions or detected user movement. For example, the control circuit 408 may control the wheels 217, 218 to move the dribble training apparatus to intercept the user, or may control the wheels 217, 218 to shadow or smoothly engage the user. According to an embodiment, movement of the dribble training apparatus 200 via the wheels 217, 218 may be controlled remotely via the control circuitry 408 (including wireless data communication circuitry), or may be preprogrammed.

According to an embodiment, the vertical riser 221, the first obstacle 232 and the second obstacle 234 may be integrated as elements of an inflatable obstacle assembly. For example each of the vertical riser 221, the first obstacle 232 and the second obstacle 234 may be portions of a single inflatable obstacle assembly. A proximate end of the vertical riser 221 may be sized or otherwise configured to securely engage the receptacle of the drive structure 214. For example, the proximate end of the vertical riser 221 may include nubs that correspond to cutouts in the receptacle.

Although electrical and control elements are described primarily with respect to embodiments illustrated in FIGS. 2-4, those having skill in the art will acknowledge and accept that elements such as a camera 215, controller 408, motor 402, battery 404 are applicable to embodiments, such as those described below, in which such features are housed in or attached to a structure other than a base structure.

Figure 5A:
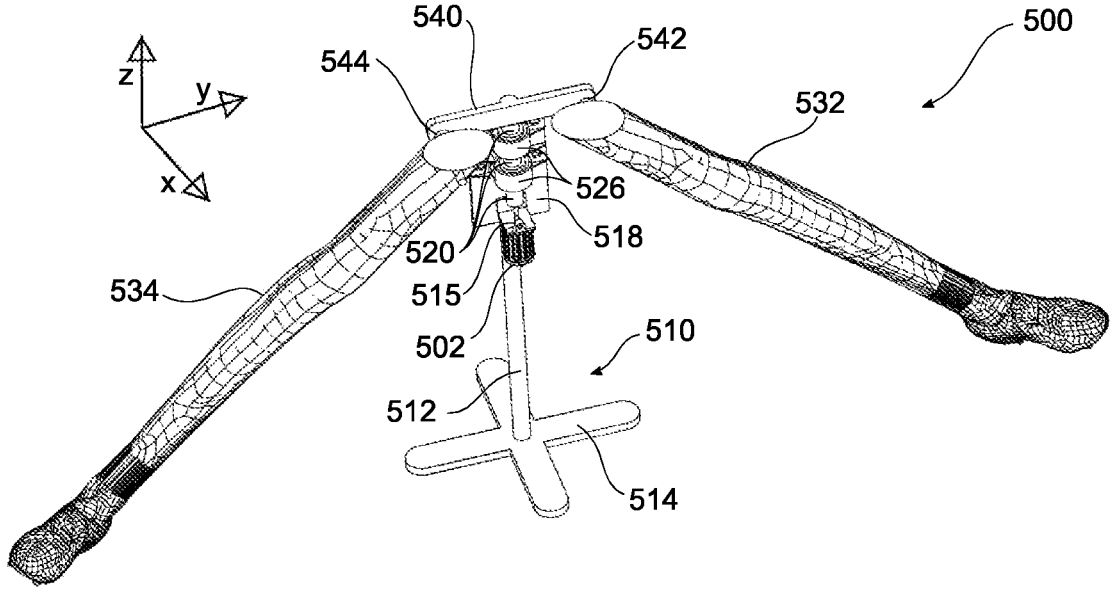
FIG. 5A is a perspective view of a dribble training apparatus, according to another embodiment.
Figure 5B:
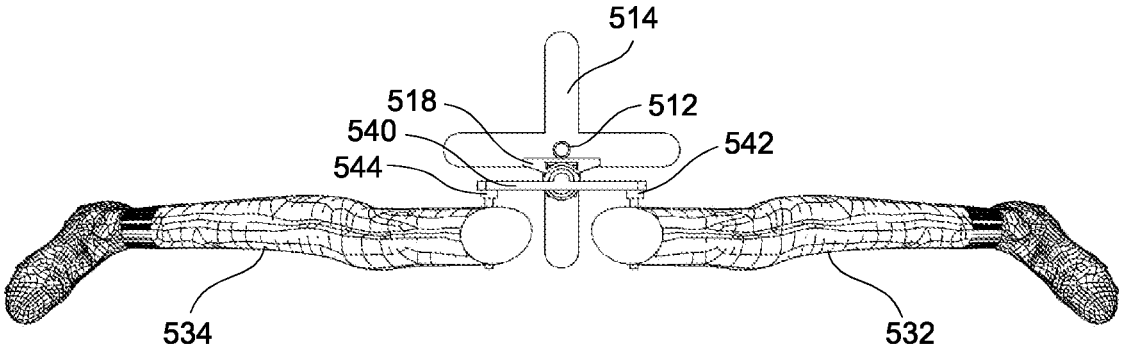
FIG. 5B is a top view of a dribble training apparatus, according to an embodiment.
Figure 5C:
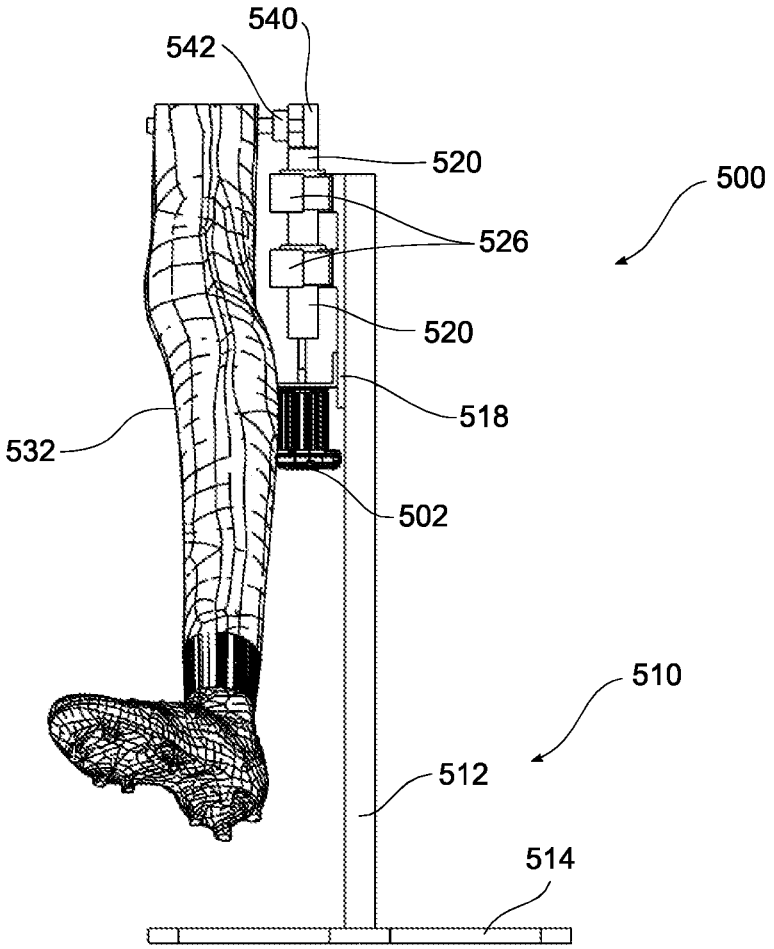
FIG. 5C is a right side view of a dribble training apparatus, according to an embodiment.

FIGS. 5A-5C illustrate another embodiment of the dribble training apparatus that, while in keeping with the overall invention, include features in a different way and may include alternative features. For example, laterally controllable obstacles are described. FIG. 5A is a perspective view of a dribble training apparatus 500, according to an embodiment. FIG. 5B is a top view of the dribble training apparatus 500, and FIG. 5C is a right side view of the dribble training apparatus 500, according to an embodiment.

In embodiments of a dribble training apparatus 500 corresponding to FIGS. 5A-5C, a base support structure 510 includes a fixed vertical support structure 512 disposed along a second vertical axis that is parallel and adjacent to the first vertical axis. The fixed vertical support may a metal or (for improved portability) plastic/fiberglass/carbon fiber pipe or rod. A stabilizer base 514 extends radially from a proximal end of the vertical support structure to provide stable support for the dribble training apparatus 500 against a playing surface. The stabilizer base may include one or more of a heavy disc, a plurality of legs securely extending away from the second vertical axis or the like. The stabilizer base may include screws, grass spikes, or may accommodate stakes driven therethrough into the ground. For portability, a wide base may be sufficient in some embodiment.

The dribble training apparatus 500 may further include a vertical plate 518 affixed to a distal end of the vertical support structure 512 and substantially perpendicular to a playing surface when in use. One or more bearings 526 may be affixed to the vertical plate 520 to accommodate a vertical shaft therethrough. A rotating structure 520 (corresponding to the rotating structure 220 described above) may include the vertical shaft, rotatably disposed through the one or more bearings 526 and a top plate 540 may be disposed across and affixed to or integrated with a distal end of the vertical shaft (identified as 520 in the Figures). For example, the top plate 540 and vertical shaft (520) together may form a "T" shape. However, those having skill in the art will acknowledge that the a shape is less important than the functionality and connection of the structure.

One or more obstacles 532, 534 (corresponding to elements 130, 232, 234) comprise a left obstacle 532 operably connected at its proximal end to a left end of the top plate 540 and a right obstacle 534 operably connected at its proximal end to a right end of the top plate 540. A first motor 502 (corresponding to the motor 402 described above) may be affixed to or otherwise supported by the vertical plate 518. An axle (not labeled) of the first motor 502 is operably connected to the vertical shaft of the rotation structure 520. Operation of the first motor 502 turns the rotation structure 520 and everything attached to the rotation structure 520

The left and right obstacles 532, 534 of the dribble training apparatus 500 may be connected to the top plate 540 respectively via a second motor 542 and a third motor 544. The second and third motors 542, 544 are respectively configured to rotate the left obstacle about a second horizontal axis and to rotate the right obstacle about a third horizontal axis. The second and third horizontal axes may correspond to respective axles of the second and third motors 542, 544. The second and third axes may be substantially parallel to each other and to the ground when the dribble training apparatus 500 is in operation, according to an embodiment.

The dribble training apparatus 500 may include control circuitry (not shown in FIGS. 5A-5C, corresponding to control circuitry 408 described above). The control circuitry may be operably connected to the first motor 502, second motor 542, and third motor (544) and configured to control operation of each. A power source (not shown, corresponding to the power source 404 described above) may be electrically connected to the control circuitry (408) and configured to supply electrical power to the control circuitry (408) and the first motor (502), second motor 542, and third motor (544).

As noted above, the dribble training apparatus 500 may, according to an embodiment, include one or more cameras 515 (corresponding to camera(s) 215 described above). The one or more cameras 515 may be configured to capture one or more images of a user and send the one or more images to the control circuitry 408. The control circuitry (408) may be configured to detect, in the one or more images of the user, a motion of a user. Upon detecting in the one or more images any one of a plurality of predetermined movements of the user, the control circuitry may cause at least one of: (a) the first motor 502 rotating the rotation structure 520 about the first vertical axis 122 by a predetermined amount of rotation in a predetermined rotation direction corresponding to the detected motion of the user, (b) the second motor 542 rotating the left obstacle 532 to raise or lower a distal end of the left obstacle 532, and (c) the third motor 544 rotating the right obstacle 534 to raise or lower a distal end of the right obstacle 534.

In the description provided, the term "affixed" may reference structural connection of specified elements by one or more of welds, bolts, integral formation, glue or epoxy or the like.

U.S. Pre-Grant Patent Publication No. 2016/0317890A1 discloses a device that serves to mimic an approaching offensive (i.e., ball possessing) player to extract ball. However, the machine described therein is limited in functionality. U.S. 2016/0317890A1 discloses a fixed predetermined path through barricaded chassis hardware through which the player can traverse. In contrast, the simulated dribble training apparatus (100, 200, 500) disclosed herein permits the player to make a choice to either pass left or right of the simulated defender which better simulates real sport situations.

Figure 6:
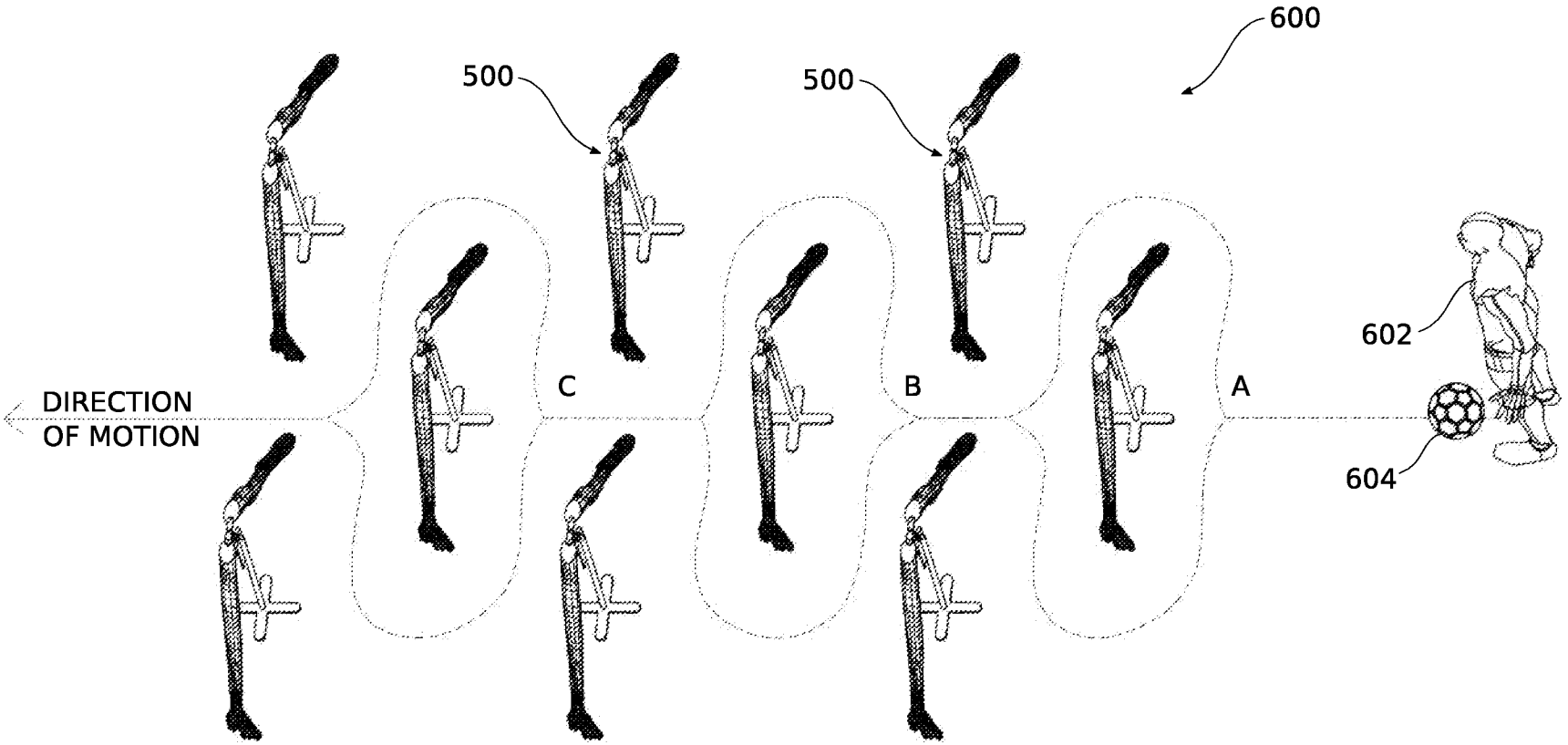
FIG. 6 illustrates use of a plurality of dribble training apparatus, according to an embodiment.
Figure 7A:
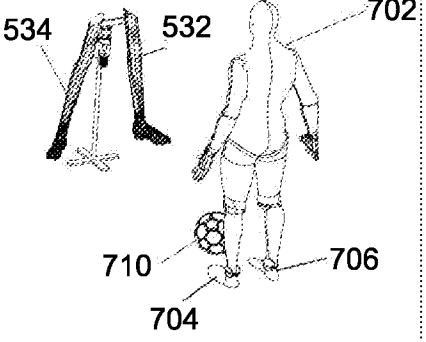
FIGS. 7A-7D are views of a dribble training apparatus in use by a Player preparing to practice a step-over, according to an embodiment.
Figure 7B:
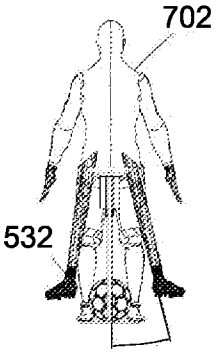
Figure 7C:
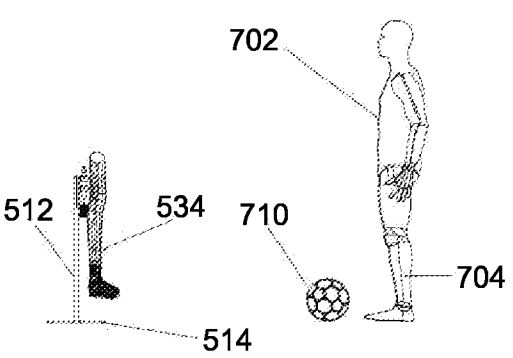
Figure 7D:
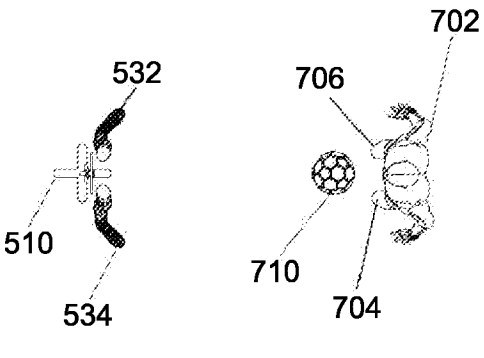
Figure 8A:
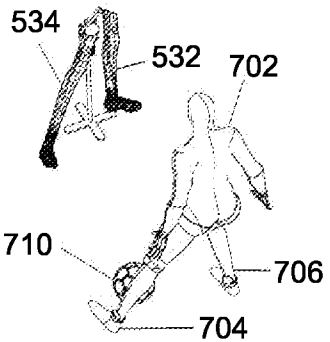
FIGS. 8A-8D are views of a dribble training apparatus in use by a Player performing a step-over, according to an embodiment.
Figure 8B:
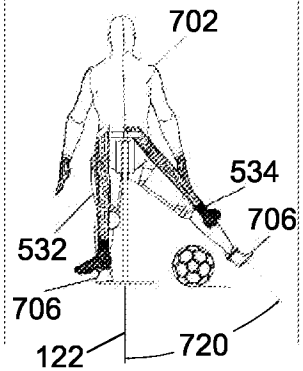
Figure 8C:
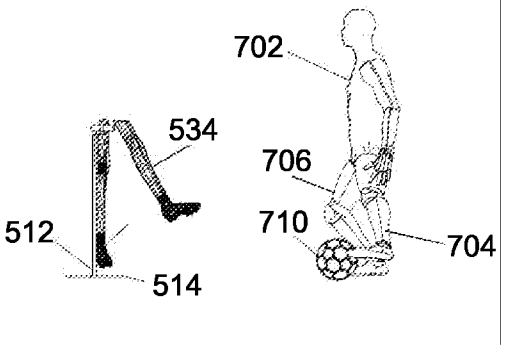
Figure 8D:
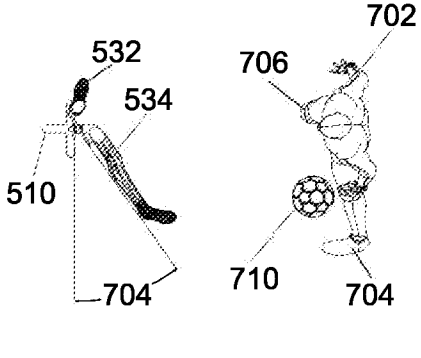
Figure 9A:
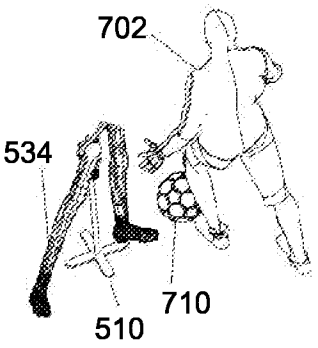
FIGS. 9A-9D illustrate views of a Player sprinting past a dribble training apparatus after performing a step-over, according to an embodiment.
Figure 9B:
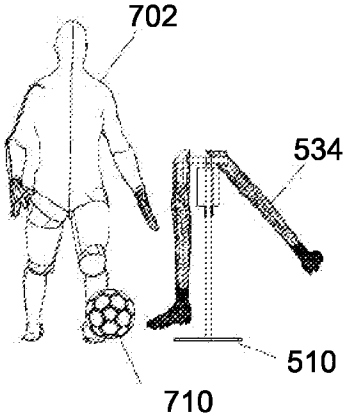
Figure 9C:
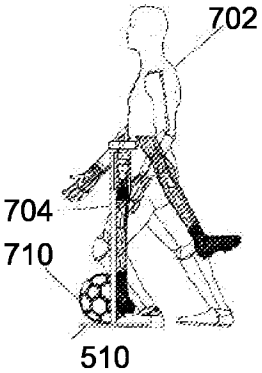
Figure 9D:
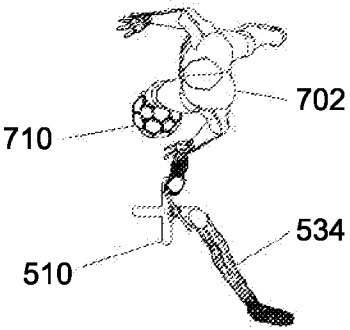
Figure 10A:
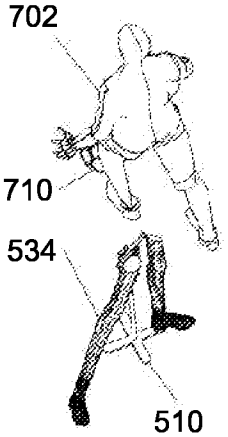
FIGS. 10A-10D illustrate views of dribble training apparatus after a Player has passed it, according to an embodiment.
Figure 10B:
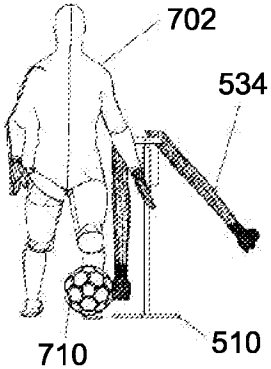
Figure 10C:
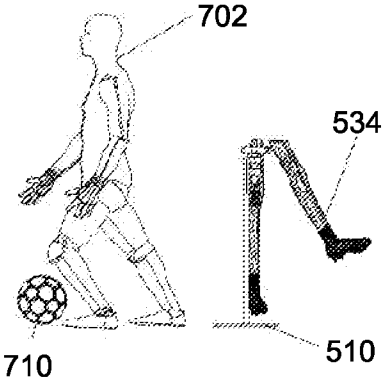
Figure 10D:
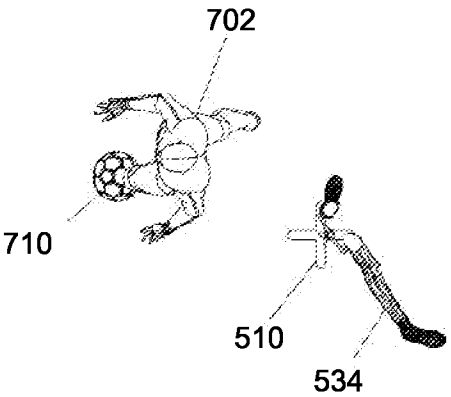

For example, in FIG. 6 a field 600 of simulated dribble training apparatus 500 may be employed to engage a user though multiple "defenders" each configured to react to the approaching player. Because the player can pass either left or right of the dribble training apparatus (100, 200, 500) disclosed herein, the dribble training apparatus can be used for added functionality such as a step-over skill.

More specifically, FIG. 6 shows multiple dribble training apparatus 500 arranged to simulate multiple defensive opponents that the player 602 must run past. The player/user 602 is challenged to learn skills such as ambidextrous dribbling and step-overs to beat or run past the obstacles of the assembled dribble training apparatus 500. FIG. 6 shows three locations i.e. A, B and C where the player has a choice to either go left or right. (Additional choices may be made for "defender" apparatuses in the outside rows.) The arrangement of the dribble training apparatus 500 machines provides the player with options of multiple possible trajectories to successfully evade the obstacles while advancing forward.

FIGS. 7A through FIG. 10D show how the player can practice skills such as step-overs with the simulated defender machine.

FIGS. 7A-7D show a dribble training apparatus 500 four perspectives (perspective, front, side, plan) as a player 702 approaches the apparatus 500 with the intention of passing, with a ball 710, the dribble training apparatus 500 as facilitated by performing a step-over.

Next, FIGS. 8A-8D respectively depict perspective, front, side and plan views illustrating operation of the dribble training apparatus 500 as a player 702 performs a step-over with the player's left leg 704 versus the dribble training apparatus 500. The dribble training apparatus 500 responds by rotating about its first vertical axis 122. and raising its right obstacle 534. The dribble training apparatus 500 employs its camera (515) and control circuitry (408) to monitor the player performing the step-over and to control the three motors 502, 542 and 544 in concert to move the two obstacles 542, 544. In some instances, one of the obstacles may only rotate around the first vertical axis 122 while the other obstacle is raised in reaction to the player's position or motion. For example, in FIGS. 8A-8D, the motor 544 rotates to lift obstacle 534, varying angle 720 to imitate, with the right-side obstacle 534, the player's raised leg 704, while the other motor 542 controls a left-side obstacle 532 to imitate a position or movement of the player's other leg 706, while the first motor 502 controls rotation of the plate 518 and corresponding affixed structure about the vertical (Z) axis 122, thus varying an angle 722 to move right obstacle 534 towards the player and left obstacle 532 away from the player. This action simulates a defensive player's attempt to extract a ball 710 from a player 702 by committing an attacking leg toward the step-over leg of a player in a game.

FIGS. 9A-9D are respectively perspective, front, side, and plan views illustrating the player 702 proceeding after the scenario of FIGS. 8A-8D to run past the non-attacking leg (left-side obstacle 532 in the illustrated scenario). In FIGS. 9A-9D the right-side obstacle 534 is raised higher than the left side obstacle 532 and therefore the path to the left of the player 702 is less open for the player than a path moving toward the right of the player 702. Thus, the player 702 easily traverses past the dribble trainer apparatus 500 on right side. This scenario simulates a player running past the non-attacking leg (obstacle 532 in the illustrated example) which is usually the leg that stays on the ground.

FIGS. 10A-10D respectively present perspective, front, side, and plan views illustrating the player 702 having completely run past the dribble trainer apparatus 500. This scenario simulates a case were the player has successfully run past the offensive players.

In some embodiments, the control circuitry 408 may include inputs and outputs for receiving and sending data. In addition to receiving sensor/camera information as described above, the control circuitry may include inputs for receiving updates to programming, stored routines, or other data. As noted above, the control circuitry may be configured to receive remote control instructions for one or more movement types. For example, a coach or parent may control one or more dribble trainer apparatus 100, 200, 500 to simulate different defensive or offensive opponent movements "on the fly". While the functionality described with respect to FIGS. 6 through 10D references the embodiments associated with FIGS. 5A-5C, it will be understood that similar functionality applies to the embodiments associated with FIGS. 2 through 4. Moreover, functionality of the embodiments associated with FIGS. 2-4 may include additional response of the dribble trainer apparatus 200 due to the ability to move as a whole via the wheels 217, 218.

The control circuitry (e.g., 408) may be is configured to store and/or transmit data to a computer or database. The data may include one or more of at least usage data, location (e.g., GPS coordinates) of the dribble training apparatus 200, 500, user identity, input user skill level, user reaction times, contact with the dribble trainer apparatus (e.g., via contact sensed by sensors in the obstacles), image data, and apparatus identification data. Such data may inform a record of user progress for e.g., coach analysis. Data from multiple units may be aggregated anonymously by a training organization, manufacturer or other authorized party to analyze trends, improve functionality, etc.

Exemplary embodiments are shown and described in the present disclosure. It is to be understood that the embodiments are capable of use in various other combinations and environments and are capable of changes or modifications within the scope of the inventive concept as expressed herein. Some such variations may include using programs stored on non-transitory computer-readable media to enable computers and/or computer systems to carry our part or all of the method variations discussed above. Such variations are not to be regarded as departure from the spirit and scope of the invention, and all such modifications as would be obvious to one skilled in the art are intended to be included within the scope of the following claims.

What is claimed is:

1. A dribble training apparatus comprising:

a base support structure;

a rotation structure extending along a vertical axis from the base support structure and configured to rotate about the first vertical axis, the rotation structure including:

a drive structure extending from the base support structure, and a vertical riser having a proximal end and a distal end, the proximal end held and driven by the drive structure;

one or more obstacles each extending downward at an angle from the distal end of the vertical riser of the rotation structure to a position proximate the ground;

a first motor operably coupled to the rotation structure and configured to cause rotation of the rotation structure about the first vertical axis;

control circuitry operably connected to the first motor and configured to control operation of the first motor;

one or more cameras mounted to or integrated with the base support structure, the one or more cameras configured to capture one or more images of a user; and a power source electrically connected to the control circuitry and configured to supply electrical power to the control circuitry and the first motor, wherein the control circuitry is configured to:

detect, in the one or more images of the user, a motion of a user, and upon detecting in the one or more images any one of a plurality of predetermined movements of the user, causing the first motor to rotate the drive structure about the vertical axis by a predetermined amount of rotation in a predetermined rotation direction corresponding to the detected motion of the user.

2. The dribble training apparatus according to claim 1, wherein the one or more obstacles each includes an anthropomorphic leg and foot.

3. The dribble training apparatus according to claim 1, wherein the base support structure includes a housing.

4. The dribble training apparatus according to claim 3, wherein the housing includes a top platform, a handle, and one or more stabilizing extensions.

5. The dribble training apparatus according to claim 4, wherein the housing includes one or more wheels.

6. The dribble training apparatus according to claim 1, wherein upon detecting in the one or more images any one of the plurality of predetermined movements of the user, causing the one or more wheels to move the dribble training apparatus in a direction to intercept the user.

7. The dribble training apparatus according to claim 1, wherein the base support structure includes a vertical support structure disposed along a second vertical axis that is parallel and adjacent to the first vertical axis, and a stabilizer base extending radially from a proximal end of the vertical support structure and providing support for the dribble training apparatus.

8. The dribble training apparatus according to claim 7, further comprising:

a vertical plate affixed to a distal end of the vertical support structure; and one or more bearings affixed to the vertical plate, wherein the rotation structure includes a vertical shaft rotatably disposed through the one or more bearings, and a top plate disposed across and affixed to or integrated with a distal end of the rotation structure, and the one or more obstacles comprise a left obstacle operably connected at a proximal end thereof to a left end of the top plate and a right obstacle operably connected at a proximal end thereof to a right end of the top plate.

9. The dribble training apparatus according to claim 8, wherein the first motor is supported by the vertical plate, and an axle of the first motor is operably connected to the vertical shaft of the rotation structure.

10. The dribble training apparatus according to claim 9, wherein the left and right obstacles are connected to the top plate respectively via a second motor and a third motor, the second and third motors constituting the mechanical drive and respectively configured to rotate the left obstacle about a second horizontal axis and to rotate the right obstacle about a third horizontal axis.

11. The dribble training apparatus according to claim 10, wherein the control circuitry is further operably connected to the second motor, and the third motor and is further configured to control operation of the second motor and the third motor; and the power source is further configured to supply electrical power to the second motor and third motor.

12. The dribble training apparatus according to claim 11, wherein:

the one or more cameras are further configured to send the one or more images to the control circuitry, wherein upon detecting in the one or more images the any one of the plurality of predetermined movements of the user, the control circuitry is further configured to cause at least one of:

said first motor rotating the rotation structure about the first vertical axis by a predetermined amount of rotation in a predetermined rotation direction corresponding to the detected motion of the user, the second motor rotating the left obstacle to raise or lower a distal end of the left obstacle, and the third motor rotating the right obstacle to raise or lower a distal end of the right obstacle.

13. The dribble training apparatus according to claim 1, wherein the control circuitry is further configured to transmit data to a computer, the data including one or more of usage data, location of the dribble training apparatus user information, image data, and apparatus identification data.

14. A dribble training apparatus according comprising:

a base support structure;

a rotation structure extending along a vertical axis from the base support structure and configured to rotate about the first vertical axis;

one or more obstacles extending downward at an angle from a top portion of the rotation structure to a position proximate the ground; and a first motor operably coupled to the rotation structure and configured to cause rotation of the rotation structure about the first vertical axis, wherein the rotation structure includes:

a drive structure extending from the base support structure; and a vertical riser, a proximal end of the vertical riser held and driven by the drive structure, a distal end of the vertical riser supporting a first obstacle of the one or more obstacles and a second obstacle of the one or more obstacles, and wherein the vertical riser, the first obstacle and the second obstacle are integrated as elements of an inflatable obstacle assembly.

* * * * *